US005295565A

United States Patent [19]

Latshaw

[11] Patent Number: 5,295,565

[45] Date of Patent: Mar. 22, 1994

[54] WHEELED LUGGAGE

[75] Inventor: Ricky Latshaw, Republic, Mo.

[73] Assignee: Purdy Neat Things Company, Republic, Mo.

[21] Appl. No.: 990,523

[22] Filed: Dec. 15, 1992

[51] Int. Cl.[5] ..... A45C 13/36

[52] U.S. Cl. ..... 190/18 A; 190/24; 190/102; 190/111

[58] Field of Search ..... 190/24, 25, 18 A, 35, 190/109, 110, 111, 102

[56] References Cited

U.S. PATENT DOCUMENTS

| | | | |
|---|---|---|---|
| Re. 28,757 | 4/1976 | Cassimally | 280/37 |
| Re. 29,036 | 11/1976 | Hager | 280/37 |
| 2,295,283 | 8/1958 | Stilger | 280/37 |
| 3,061,057 | 10/1962 | Miller | 190/111 X |
| 4,087,102 | 5/1978 | Sprague | 280/37 |
| 4,212,377 | 7/1980 | Weinreb | 190/110 X |
| 4,314,624 | 2/1982 | Royet | 190/18 |
| 4,383,141 | 5/1983 | Walker | 190/18 A |
| 4,406,353 | 9/1983 | Walker | 190/18 |
| 4,424,841 | 1/1984 | Smith | 190/110 X |
| 4,538,709 | 9/1985 | Williams et al. | 190/18 |
| 4,759,431 | 7/1988 | King et al. | 190/18 A |
| 4,817,802 | 4/1989 | Pratt | 190/110 X |
| 4,995,487 | 2/1991 | Plath | 190/18 A |
| 5,000,301 | 3/1991 | Grenier | 190/25 X |
| 5,042,664 | 8/1991 | Shyr et al. | 190/110 X |
| 5,048,649 | 9/1991 | Carpenter et al. | 190/18 |
| 5,054,589 | 10/1991 | Bomes et al. | 190/110 X |
| 5,108,119 | 4/1992 | Huang | 280/37 |
| 5,167,306 | 12/1992 | Carrigan, Jr. | 190/18 A |
| 5,178,245 | 1/1993 | Cox | 190/18 A X |
| 5,240,106 | 8/1993 | Plath | 190/102 X |

*Primary Examiner*—Allan N. Shoap
*Assistant Examiner*—Christopher McDonald
*Attorney, Agent, or Firm*—Bell, Seltzer, Park & Gibson

[57] ABSTRACT

The wheeled luggage has upper and lower cast skeletal frame members and substantially parallel tubular members interconnecting the upper and lower skeletal frame members and maintaining the skeletal frame members in a predetermined spaced apart relation so as to define a body cavity therebetween. The wheeled luggage also has a covering connected to the skeletal frame members and enclosing the body cavity with an openable fastener on the covering for providing access to the interior of the body cavity. A retractable handle having elongate substantially parallel side members telescopically is received in the tubular members and is in an extended position when the luggage is being transported. Spaced apart wheel mounting members extend from rear portions of the lower skeletal frame member and are cast integral therewith. Wheels are mounted on the wheel mounting members for facilitating the transporting of the luggage and feet extend downwardly from front portions of the lower cast skeletal frame member and are cast integral therewith. The lower end of the feet is in a common plane with the lower portions of the wheels so that the luggage may be positioned in an upright position.

18 Claims, 5 Drawing Sheets

WHEELED LUGGAGE

FIELD OF THE INVENTION

This invention relates to luggage and more particularly to wheeled luggage for carrying personal items or the like during travel.

BACKGROUND OF THE INVENTION

Extensive travel often requires the traveller to handle their own luggage in walking through airports, hotels, or other various assembling and marshalling areas. The luggage is usually heavy when fully loaded and, therefore, the traveller often uses a dolly truck, bell-hop, or sky-cap to transport the luggage through these assembling and marshalling areas. These methods of transporting the luggage, however, are sometimes impractical, difficult, expensive, or burdensome to the traveller.

To solve this luggage transporting problem, wheels and retractable handles have been added to luggage to enable the traveller to easily transport the luggage through airports, hotels, and the like. Some examples of early types of wheeled luggage may be seen in U S. Pat. No. 2,925,283 by Stilger entitled "Luggage On Wheels"; U.S. Pat. No. Re. 28,757 by Cassimally entitled "Trolley Case"; and U.S. Pat. No. Re. 29,036 by Hager entitled "Luggage Transport Structure." Some types of wheeled luggage, such as seen in U.S. Pat. No. 4,087,102 by Sprague entitled "Hand Carryable Travel Container Convertable To Rollable Cart" and U.S. Pat. No. 4,314,624 by Royet entitled "Wheel-Mounted Luggage", have added retractable wheels to enhance the portability of the luggage. Others have attempted to strengthen the pulling or handle mechanism as seen in U.S. Pat. No. 5,048,649 by Carpenter et al. entitled "Luggage With PullHandle." Still others have applied the wheels and handle to garment bags to improve their portability as seen in U.S. Pat. No. 4,406,353 by Walker entitled "Wheeled Garment Bag" and U.S. Pat. No. 4,538,709 by Williams et al. entitled "Wheeled Garment Bag."

As also seen by the examples in U.S. Pat. No. 4,995,487 by Plath entitled "Wheeled Suitcase And Luggage Support" and U.S. Pat. No. 5,108,119 by Huang entitled "Wheeled Carrying Case", the wheeled luggage is typically constructed or manufactured by adding wheel mounts and wheels to a luggage body, welding together frames for the luggage, and/or mounting retractable handles thereon. The various types of wheeled luggage also usually receive rough treatment by the frequent traveller or luggage handling personnel. The previous wheeled luggage, however, does not provide structural strength, lightweight for ease of transporting and lifting, and ease of manufacturing because of the various manufacturing techniques required.

Thus, there is a need for wheeled luggage that is still lightweight, has structural strength, and is relatively easy to manufacture for the frequent traveller such as an airplane pilot or airplane stewardess.

SUMMARY OF THE INVENTION

Therefore, the present invention provides wheeled luggage that is lightweight, has structural strength, and is relatively easy to manufacture.

More particularly, the wheeled luggage has upper and lower cast skeletal frame members and substantially parallel tubular members interconnecting the upper and lower skeletal frame members and maintaining the skeletal frame members in a predetermined spaced apart relation so as to define a body cavity therebetween. The wheeled luggage also has a covering connected to the skeletal frame members and enclosing the body cavity with an openable fastener on the covering for providing access to the interior of the body cavity. A retractable handle having elongate substantially parallel side members is telescopically received in the tubular members and is in an extended position when the luggage is being transported. Spaced apart wheel mounting members extend from rear portions of the lower skeletal frame member and are cast integral therewith. Wheels are mounted on the wheel mounting members for facilitating the transporting of the luggage. Feet extend downwardly from front portions of the lower cast skeletal frame member and are cast integral therewith. The lower end of the feet is in a common plane with the lower portions of the wheels so that the luggage may be positioned in an upright position.

BRIEF DESCRIPTION OF THE DRAWINGS

Some of the features and advantages of the present invention having been stated, others will become apparent as the description proceeds when taken in conjunction with the accompanying drawings, in which.

DESCRIPTION OF A PREFERRED EMBODIMENT

The present invention now will be described more fully hereinafter with reference to the accompanying drawings in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
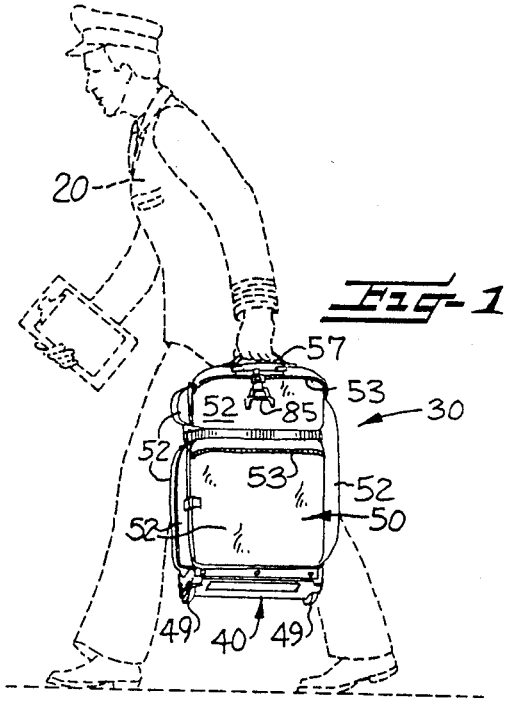
FIG. 1 is an environmental view of the wheeled luggage according to the present invention being carried by an airplane pilot shown in phantom lines.
Figure 2:
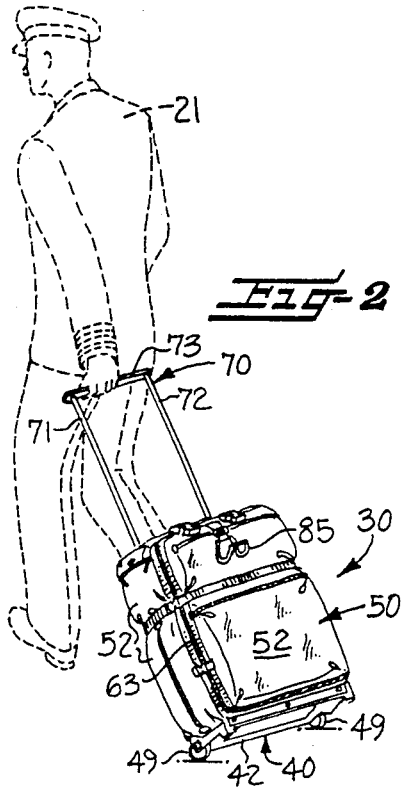
FIG. 2 is an environmental view of the wheeled luggage according to the present invention being pulled with the extended retractable handle by an airplane pilot shown in phantom lines.
Figure 3:
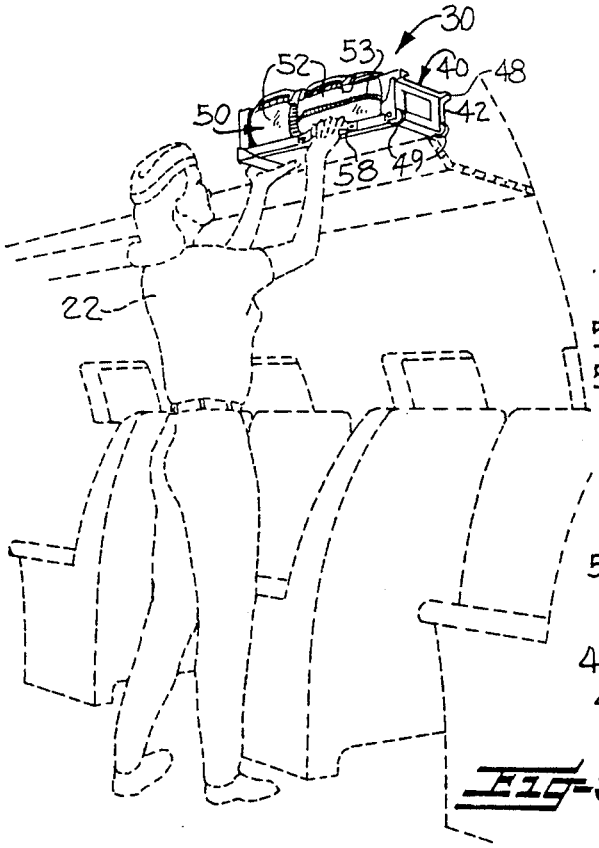
FIG. 3 is an environmental view of the wheeled luggage being removed from an overhead storage compartment of an airplane by a stewardess shown in phantom lines.

Referring now to the drawings, FIGS. 1-3 are environmental views of the wheeled luggage broadly designated at 30 according to the present invention in use by frequent travellers such as an airplane pilot 20, 21 or a stewardess 22. FIG. 1 is an environmental view of the wheeled luggage 30 being carried by a airplane pilot 20 shown in phantom lines. FIG. 2 shows the wheeled luggage 30 pulled with an extended retractable handle, broadly designated at 70, by an airplane pilot 21. FIG. 3 shows the wheeled luggage 30 being removed from an overhead storage compartment on an airplane by a stewardess 22 in phantom lines to illustrate the lightweight and portability of the wheeled luggage 30 according to the present invention.

Figure 4:
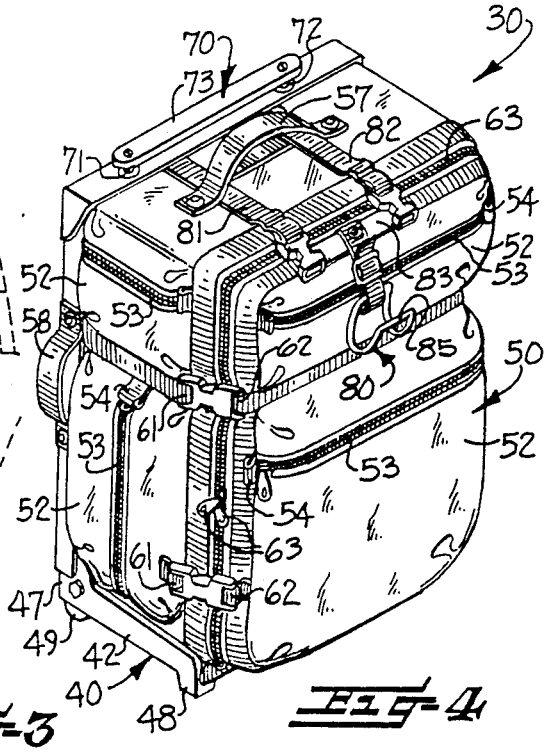
FIG. 4 is a perspective view of the wheeled luggage according to the present invention.

FIGS. 4-10 show various views of the wheeled luggage 30 illustrating the outward appearance and construction. FIG. 4 is a perspective view of the wheeled luggage 30 with the retractable handle 70 in a retracted position according to the present invention. The wheeled luggage 30 has a structural frame 40 and a covering 50 enclosing portions of the frame 40 to form a body cavity. The covering 50 forms a substantially rectangular enclosure and includes exteriorly accessible pockets 52 extending along the front, back, and sides of the enclosure. The covering 50 also has zippers 53 associated with each of the pockets 52 for controlling access thereto. Protective tabs 54 overlie ends of the zippers 53 for protectively shielding the zippers 53 from damage and inadvertent opening thereof. An upper hand engageable lifting member 57 formed of pliable fabric connects to the covering 50 and the frame 40 at an upper end thereof for facilitating manual lifting of the luggage 30. A side hand engageable lifting member 58 formed of pliable fabric connects to the covering 50 and the frame 40 at a side thereof for facilitating the manual lifting of the luggage from a different position than upperhand member 57.

Figure 5:
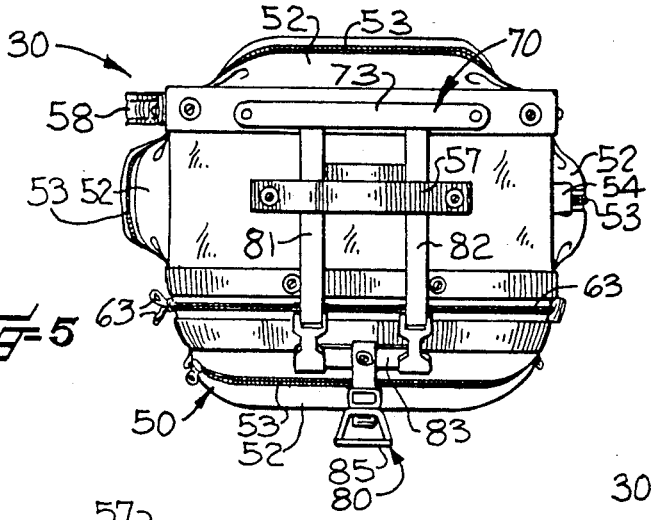
FIG. 5 is a top plan view of the wheeled luggage according to the present invention.
Figure 6:
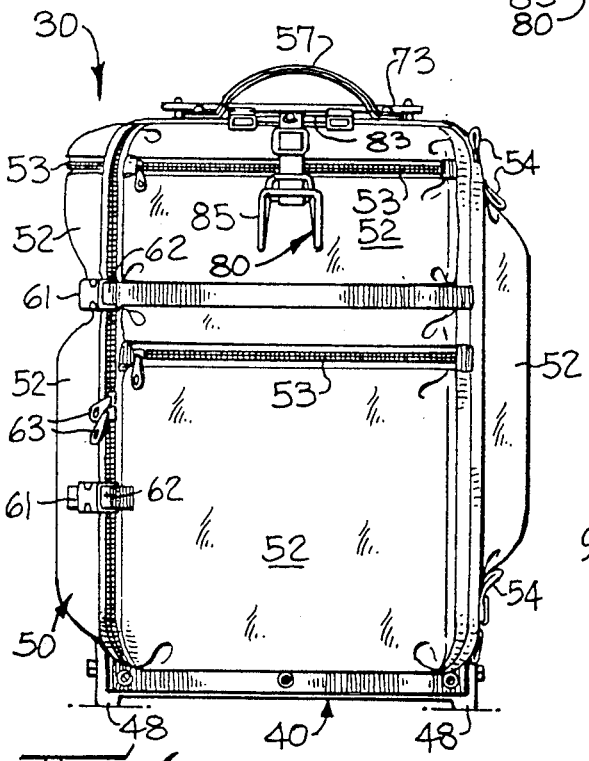
FIG. 6 is a front elevational view of the wheeled luggage according to the present invention.

FIG. 5 is a top plan view of the wheeled luggage 30 according to the present invention. This view further illustrates the positional location of the upper hand engageable lifting member 57, the retractable handle 70, and the various pockets 52 of the covering 50. FIG. 6 is a front elevational view of the wheeled luggage 30. This view shows an openable fastener means in the form of mating strap fasteners 61, 62 and a pair of zippers 63 on the covering 50 for providing access to the interior of the body cavity. Like the pockets 52, protective tabs 54 overlie ends of the zippers 63 for protectively shielding the zippers 63 from damage and inadvertent openings.

Figure 7:
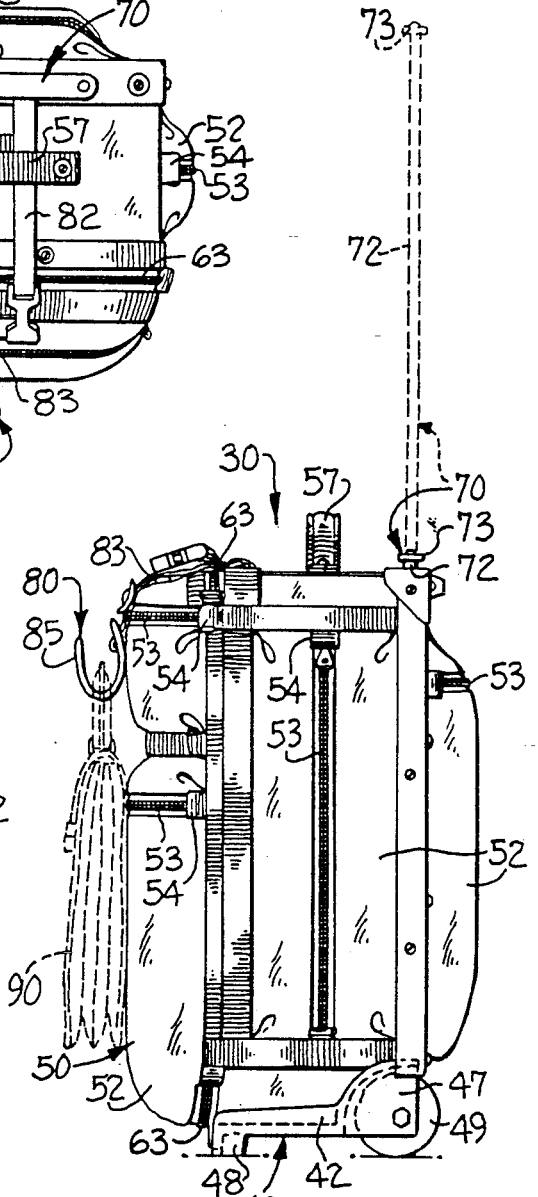
FIG. 7 is a side elevational view of the wheeled luggage having the retractable handle extended in phantom lines and a briefcase attached thereto also in phantom lines.

FIG. 7 is a side elevational view of the wheeled luggage 30 having the retractable handle 70 extended in phantom lines and a briefcase 90, also in phantom lines, attached to an auxiliary carrier means broadly designated at 80 of the wheeled luggage. The auxiliary carrier means 80 is provided for carrying a briefcase 90 and the like exteriorly of the luggage 30. The auxiliary carrier means 80 is shown in the form of a pair of pliable straps 81, 82 overlying upper and upperfront portions of the covering 50 and the frame 40, a bar 83 overlying front portions of the covering 50 and connected to the pair of straps 81, 82, and a carrier bracket 85 connected to and depending from the bar 83 and adapted to receive a handle of a briefcase 90 for carrying the same.

Figure 8:
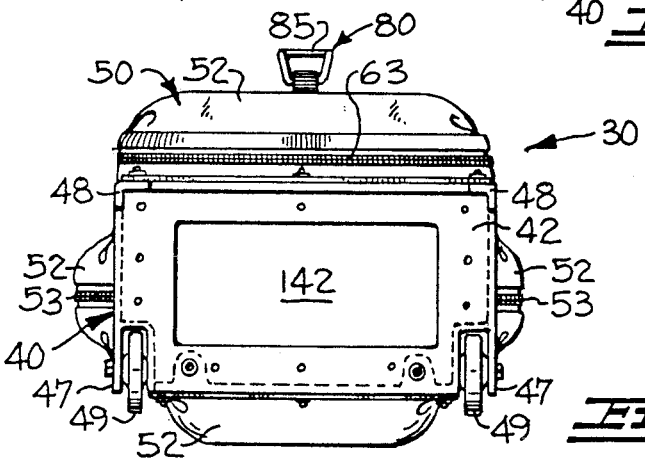
FIG. 8 is a bottom plan view of the wheeled luggage according to the present invention.
Figure 9:
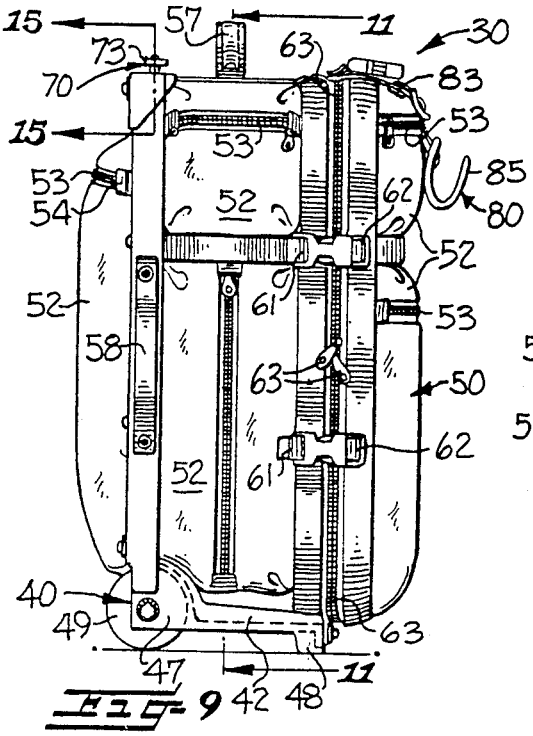
FIG. 9 is another side elevational view of the wheeled luggage showing the side pockets of the covering according to the present invention.
Figure 10:
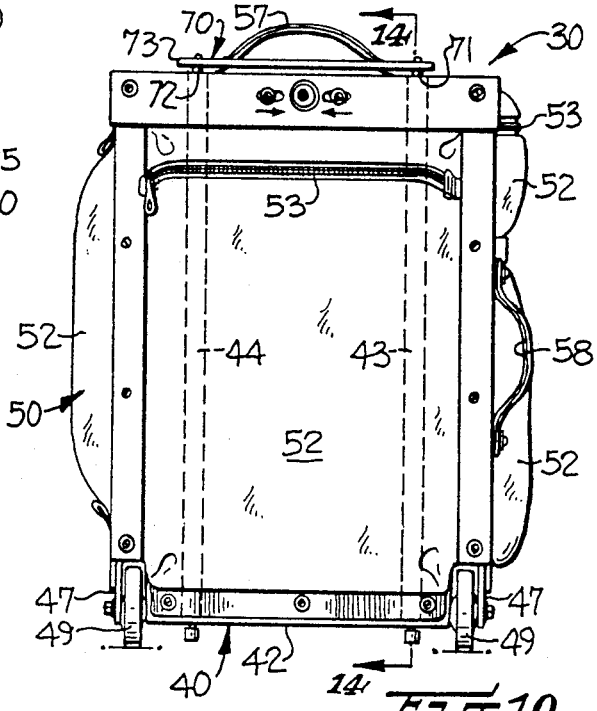
FIG. 10 is a rear elevational view of the wheeled luggage showing the rear pocket of the covering and the tubular members extending between the upper and lower cast frame members in phantom lines.

FIG. 8 is a bottom plan view of the wheeled luggage 30 according to the present invention. This view shows a lower cast frame member 42, wheel mounting members 47, and wheels 49 of the wheeled luggage 30. FIG. 9 is another side elevational view of the wheeled luggage 30 showing the side pockets 52 in the covering 50 according to the present invention and further showing the mating fasteners 61, 62 and zippers 63 on the front opening to the body cavity. FIG. 10 is a rear elevational view of the wheeled luggage 30 showing the rear pocket 52 in the covering 50 and tubular members 43, 44 extending between an upper cast frame member 41 and the lower cast frame members 42 in phantom lines.

Figure 11:
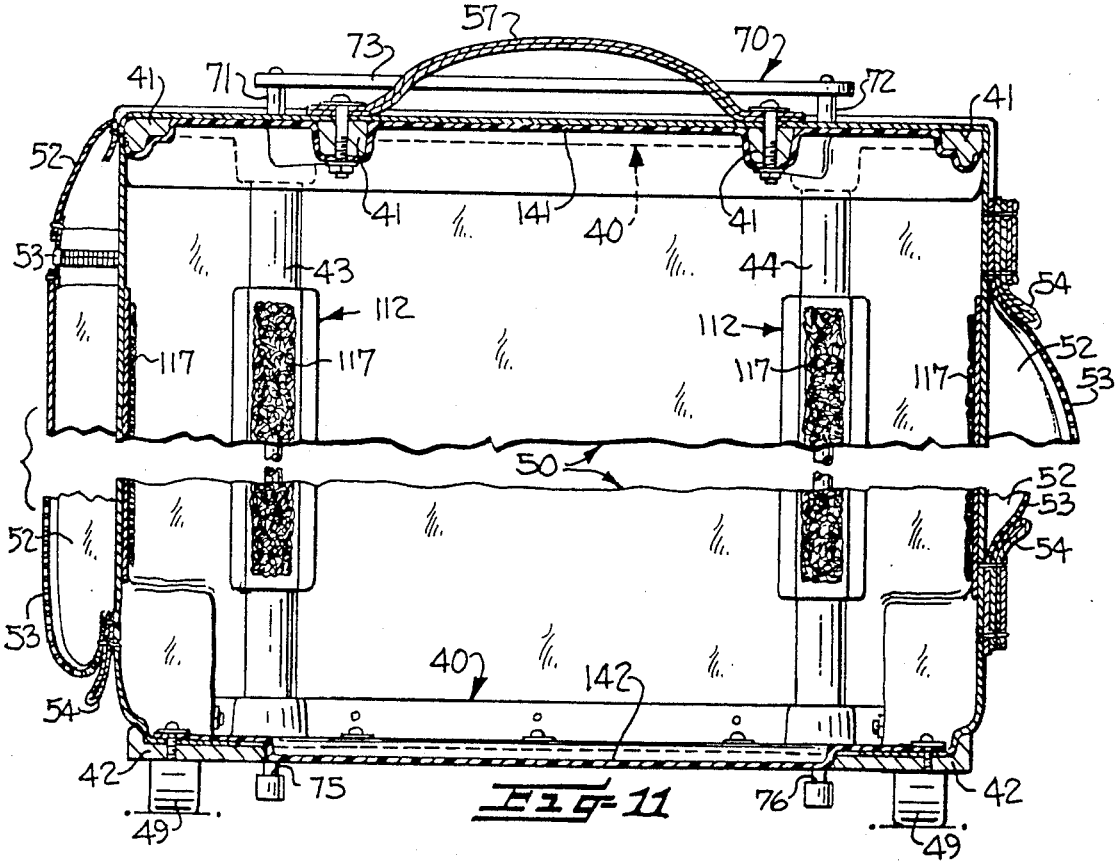
FIG. 11 is a front partial cross-sectional view of the wheeled luggage taken along line 11—11 of FIG. 9 showing the interior rear wall thereof.

FIGS. 11-14 further show the construction of the structural frame 40 of the wheeled luggage 30 and the attachment of the covering 50 to the structural frame 40. FIG. 11 is a front partial cross-sectional view of the wheeled luggage 30 taken along line 11—11 of FIG. 9. This view shows the attachment of a divider wall 111 and the tubular members 43, 44 to the covering 50 as discussed and further illustrated with reference to FIGS. 12 and 13.

Figures 12, 13:
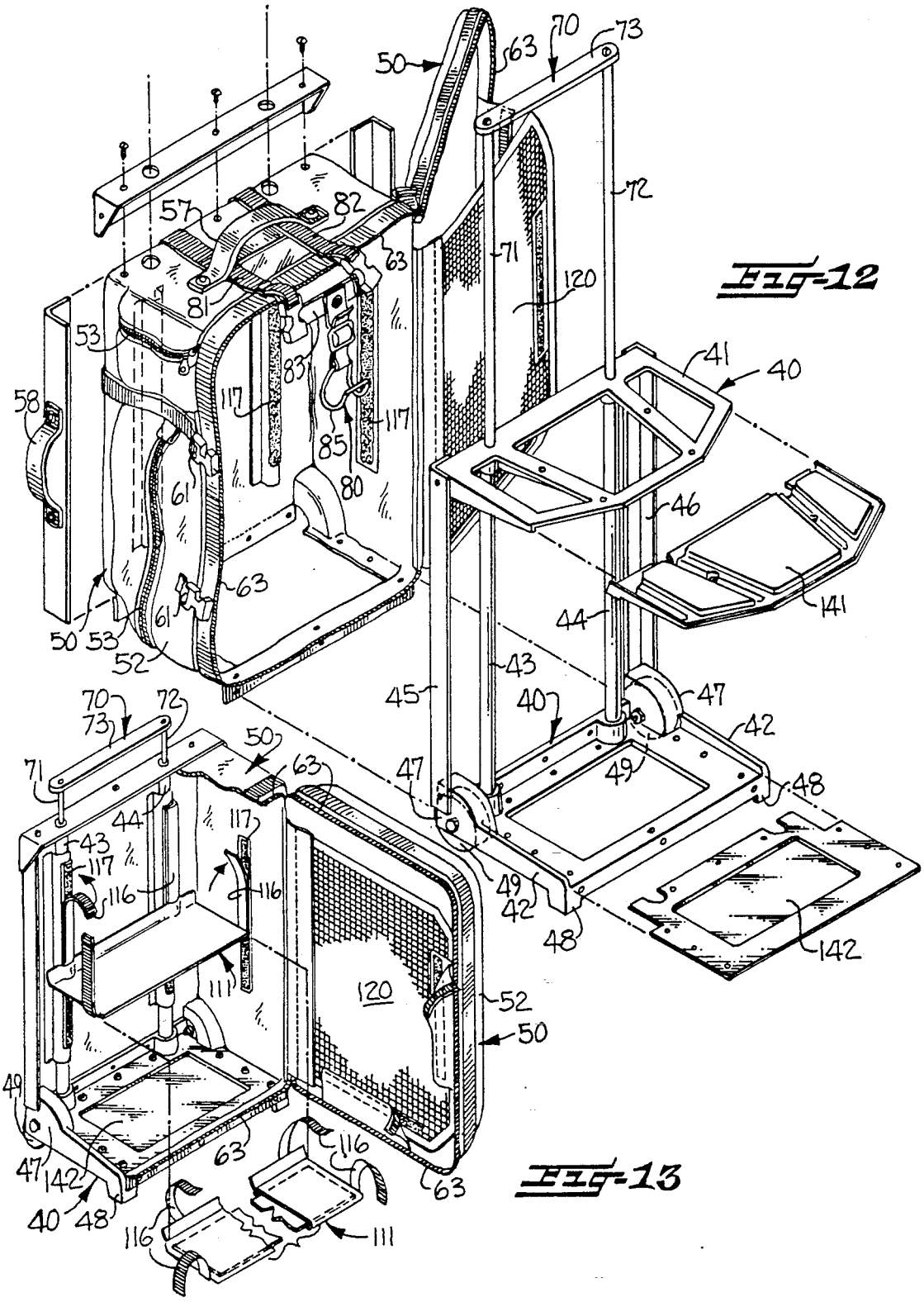
FIG. 12 is an exploded view of the wheeled luggage showing the framed structure and covering according to the present invention.
FIG. 13 is a fragmentary perspective view of the wheeled luggage opened and with parts broken away for clarity.
Figure 14:
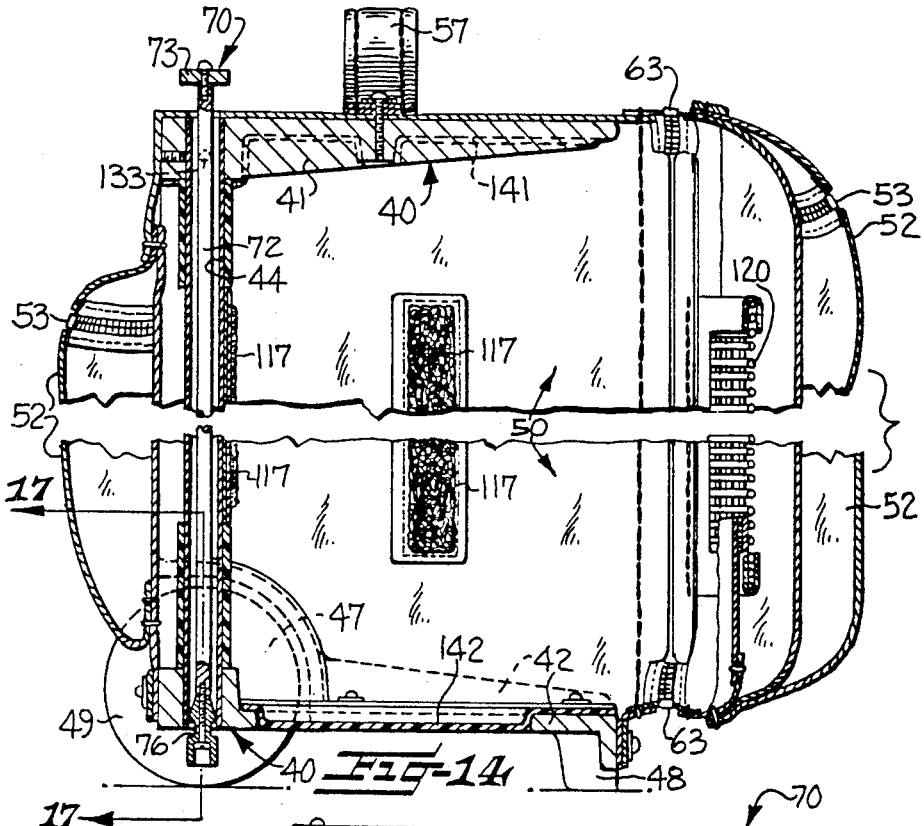
FIG. 14 is a vertical cross sectional view of the wheeled luggage taken along line 14—14 of FIG. 10 showing an interior side wall thereof.

FIG. 12 is an exploded view of the wheeled luggage 30 showing the framed structure 40 and covering 50 according to the present invention. The wheeled luggage 30 has upper 41 and lower 42 cast skeletal frame members and substantially parallel tubular members 43, 44 interconnecting the upper 41 and lower 42 skeletal frame members and maintaining the skeletal frame members 41, 42 in a predetermined spaced apart relation so as to define a body cavity therebetween. A pair of spaced apart elongate angle members 45, 46 connect rear corner portions of the upper skeletal frame member 41 to rear corner portions of the lower skeletal frame member 42 for imparting added rigidity to the luggage 30 and for protection against damage during usage. Upper 141 and lower 142 plastic molded frame covering members are connected to the upper 41 and lower 42 skeletal frame members for appearance purposes of the interior of the body cavity. The covering 50, formed of pliable fabric, connects to the skeletal frame members 41, 42 and the elongate angle members 45, 46 and encloses the body cavity. The openable fastener means 60 including a zipper 63 on the covering 30 provides access to the interior of the body cavity. The covering 50 also has a mesh pocket 120 connected to a front portion thereof. The mesh pocket provides ease of access and breathability for items stored therein. The tubular members 43, 44 telescopically receive the retractable generally U-shaped handle 70 having the elongate substantially parallel side members 71, 72. The handle 70 is in an extended position when the luggage 30 is being transported. Pairs of spaced apart wheel mounting members 47 extend from rear portions of the lower skeletal frame member 42 and are cast integral therewith. A wheel 49 is mounted on each pair of the wheel mounting members 47 for facilitating the transporting of the luggage 30. A pair of feet 48 extend downwardly from front portions of the lower cast skeletal frame member 42 and are also cast integral therewith. The lower ends of the feet 48 are in a common plane with the lower portions of the wheels 49 so that the luggage 30 may be positioned in an upright position.

FIG. 13 is a fragmentary perspective view of the wheeled luggage 30 opened and with parts broken away for clarity. As shown in this view, the divider wall 111 extends transversely across the body cavity within the covering 50, and wherein divider wall fastener means broadly designated at 112, also shown in FIG. 11, connect the divider wall 111 to the covering 50. The fastener means 112 has first components 116 connected to the divider wall 111 and second components 117 connected to the covering and cooperate with the first components for adjustably varying the position of the divider wall 111. The first components 116 are shown as a plurality of straps having one of mating Velcro-type fasteners connected thereto. The second components 117 are shown as fabric portions having the opposite mating Velcro-type fastener connected to the side walls of the covering 50, as further shown in FIG. 14, and the rear wall of the covering 50 extending around and along the tubular members 43, 44, as further shown in FIG. 11. The mating Velcro-type fasteners generally comprise the hooks and loops known to those skilled in the art. As shown, the divider wall 111 provides means for adjustably dividing the body cavity into sections of relatively similar or different heights.

Figure 15:
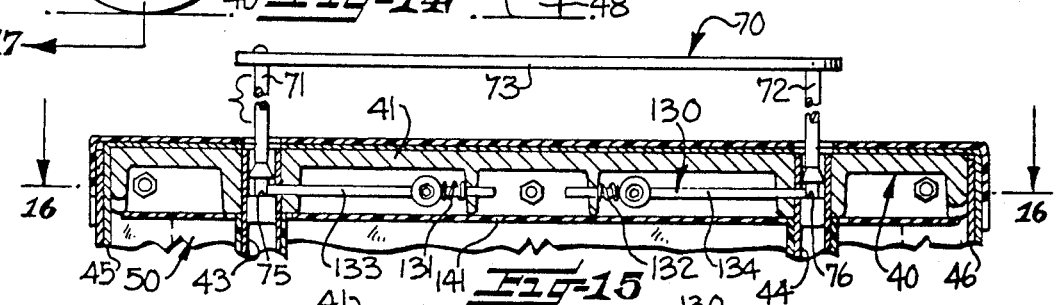
FIG. 15 is a front cross-sectional view of the spring biased latch for the retractable handle according to the present invention taken along line 15 15 of FIG. 9.
Figure 16:
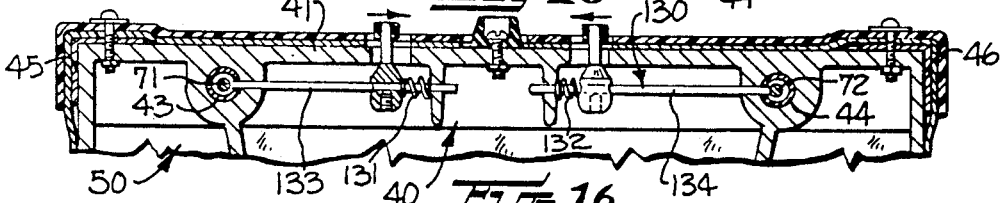
FIG. 16 is a cross-sectional view of the spring biased latch taken along line 16—16 of FIG. 15.
Figure 17:
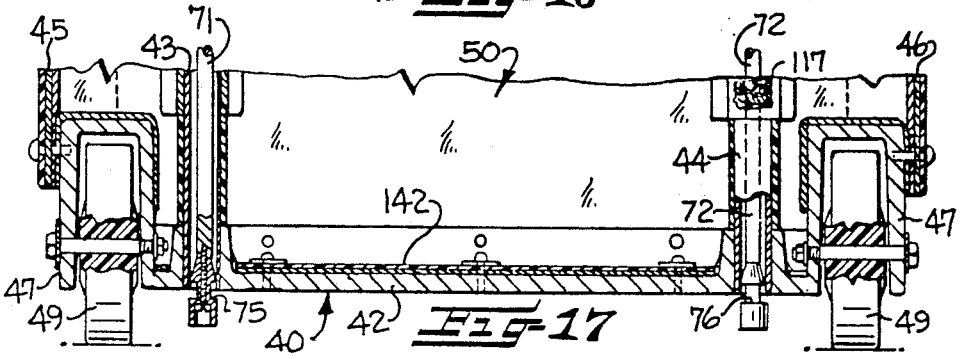
FIG. 17 is a front cross-sectional view of the wheeled luggage taken along line 17—17 of FIG. 14 showing the reduced diameter lower portions of the side members of the handle.

FIGS. 15-17 further show the construction of the latching of the retractable handle 70 for pulling or toting the wheeled luggage 30. FIG. 15 is a front cross-sectional view of the spring biased latching means shown in the form of the spring bias latch broadly designated at 130 for the retractable handle 70 according to the present invention taken along line 15—15 of FIG. 9. The spring biased latch 130 mounts on the upper cast skeletal frame member 41. FIG. 16 is a cross-sectional view of the spring biased latch 130 taken along line 16—16 of FIG. 15 to further illustrate the construction thereof. The spring biased latch 130 is shown in the form of springs 131, 132 mounted to rods 133, 134 carried by the upper skeletal frame member 41. FIG. 17 is a front cross. sectional view of the wheeled luggage 30 taken along line 17—17 of FIG. 14. The parallel side members 71, 72 of the retractable handle 70 have notches 75, 76 therein adjacent the lower ends thereof as shown in this view for cooperating with the latching means 130 for locking the handle 70 in an extended use position.

In the drawings and specification, there has been disclosed a typical preferred embodiment of the invention and, although specific terms are employed, they are used in a generic and descriptive sense only and not for the purposes of limitation, the scope of the invention being set forth in the following claims.

I claim:

1. Wheeled luggage, comprising:

respective upper and lower cast skeletal frame members;

substantially parallel tubular members interconnecting said upper and lower cast skeletal frame members and maintaining the skeletal frame members in a predetermined spaced apart relation so as to define a body cavity therebetween;

a covering connected to said skeletal frame members and enclosing said body cavity;

openable fastener means on said covering for providing access to the interior of said body cavity;

a retractable handle having elongate substantially parallel side members telescopically received in said tubular members and being in an extended position when the luggage is being transported;

spaced apart wheel mounting members extending from rear portions of said lower cast skeletal frame member and cast integral therewith;

wheels mounted on said wheel mounting members for facilitating the transporting of the luggage; and feet means extending downwardly from front portions of said lower cast skeletal frame member and cast integral therewith for providing front support for the luggage when in an upright position, the lower end of said feet means being in a common plane with the lower portions of said wheels so that the luggage may be positioned in an upright position.

2. A wheeled luggage according to claim 1 wherein;

a divider wall extends transversely across said body cavity within said covering, and wherein fastener means connect said divider wall to said covering, said fastener means having first components connected to said divider wall and second components connected to said covering and cooperating with said first components for adjustably varying the position of said divider wall.

3. A wheeled luggage according to claim 1 further including spring biased latching means mounted on said upper cast skeletal frame member, and wherein said parallel side members of said retractable handle have notches therein adjacent the lower ends thereof for cooperating with said latching means for locking the handle in extended use position.

4. A wheeled luggage according to claim 1 wherein said covering enclosing said body cavity forms a substantially rectangular enclosure and includes exteriorly accessible pockets extending along the front, back, and sides of said enclosure, and zippers associated with each of said pockets for controlling access thereto.

5. A wheeled luggage according to claim 4 including protective tabs overlying ends of said zippers for protectively shielding the same from damage and inadvertent opening of said zippers.

6. A wheeled luggage according to claim 1 further including a hand engageable lifting member formed of pliable fabric connected to said upper cast skeletal frame member for facilitating manual lifting of the luggage.

7. A wheeled luggage according to claim 1 including auxiliary carrier means for carrying a briefcase and the like exteriorly of the luggage, said auxiliary carrier means including a pair of pliable straps overlying upper portions of said covering and said upper skeletal frame member and upper front portions of said covering, a bar overlying front portions of said covering and connected to said pair of straps, and a carrier bracket connected to and depending from said bar and being adapted to receive a handle of a briefcase for carrying the same.

8. A wheeled luggage according to claim 1 including a pair of spaced apart elongate angle members connecting rear corner portions of said upper skeletal frame member to rear corner portions of said lower skeletal frame member for imparting added rigidity to the luggage for protection against damage during usage.

9. A wheeled luggage according to claim 1 wherein said covering includes a rear wall, and wherein said tubular members interconnecting said upper and lower case skeletal frames are positioned inside of said covering closely adjacent said back wall for enhanced aesthetics and wherein means inside said covering connect said back wall to said tubular members to limit outward movement of said rear wall.

10. A wheeled luggage according to claim 1 wherein said covering includes a rear wall, and wherein channels formed of pliable fabric are provided on the interior of said rear wall and are connected thereto and so positioned thereon to surround said tubular members and to limit outward movement of said rear wall.

11. Wheeled luggage, comprising:

respective upper and lower cast skeletal frame members;

substantially parallel tubular members interconnecting said upper and lower skeletal frame members and maintaining the skeletal frame members in a predetermined spaced apart relation so as to define a body cavity therebetween;

a covering formed of pliable fabric connected to said skeletal frame members and enclosing said body cavity;

openable fastener means including a zipper on said covering for providing access to the interior of said body cavity;

a retractable handle, having elongate substantially parallel side members telescopically received in said tubular members, and being in an extended position when the luggage is being transported;

pairs of spaced apart wheel mounting members extending from rear portions of said lower case skeletal frame member and cast integral therewith;

a wheel mounted on each pair of said wheel mounting members for facilitating the transporting of the luggage; and a pair of feet extending downwardly from front portions of said lower cast skeletal frame member and cast integral therewith and providing front support for the luggage when in an upright position, the lower ends of said feet being in a common plane with the lower portions of said wheels so that the luggage may be positioned in an upright position.

12. A wheeled luggage according to claim 11 including protective tabs overlying opposite ends of said zipper for protectively shielding the same from damage and inadvertent opening of the zipper.

13. A wheeled luggage according to claim 11 wherein said covering enclosing said body cavity forms a substantially rectangular enclosure and includes exteriorly accessible pockets extending along the front, back, and sides of said enclosure, and zippers associated with each of said pockets for controlling access thereto.

14. A wheeled luggage according to claim 11 including auxiliary carrier means for carrying a briefcase and the like exteriorly of the luggage, said auxiliary carrier means including a pair of pliable straps overlying upper portions of said covering and said upper skeletal frame member and upper front portions of said covering, a bar overlying front portions of said covering and connected to said pair of straps, and a carrier bracket connected to and depending from said bar and being adapted to receive a handle of a briefcase for carrying the same.

15. A wheeled luggage according to claim 11 including a pair of spaced apart elongate angle members connecting rear corner portions of said upper skeletal frame member to rear corner portions of said lower skeletal frame member for imparting added rigidity to the luggage for protection against damage during usage.

16. A wheeled luggage according to claim 11 wherein said covering includes a rear wall, and wherein said tubular members interconnecting said upper and lower cast skeletal frames are positioned inside of said covering closely adjacent said back wall for enhanced aesthetics and wherein means inside said covering connect said back wall to said tubular members to limit outward movement of said rear wall.

17. A wheeled luggage according to claim 11 wherein said covering includes a rear wall, and wherein channels formed of pliable fabric are provided on the interior of said rear wall and are connected thereto and so positioned thereon to surround said tubular members and to limit outward movement of said rear wall.

18. Wheeled luggage, comprising:

respective upper and lower cast skeletal frame members;

substantially parallel tubular members interconnecting said upper and lower cast skeletal frame members and maintaining the skeletal frame members in a predetermined spaced apart relation so as to define a body cavity therebetween;

a pair of spaced apart elongate angle members connecting rear corner portions of said upper cast skeletal frame member to rear corner portions of said lower cast skeletal frame member for imparting added rigidity to the luggage for protection against damage during usage;

a covering formed of pliable fabric connected to said cast skeletal frame members and said elongate angle members and enclosing said body cavity;

openable fastener means including a zipper on said covering for providing access to the interior of said body cavity;

a retractable generally U-shaped handle having elongate substantially parallel side members telescopically received in said tubular members and being in an extended position when the luggage is being transported;

spring biased latching means mounted on said upper cast skeletal frame member, and wherein said parallel side members of said retractable handle have notches therein adjacent the lower ends thereof for cooperating with said latching means for locking the handle in extended use position;

pairs of spaced apart wheel mounting members extending from rear portions of said lower skeletal frame member and cast integral therewith;

a wheel mounted on each pair of said wheel mounting members for facilitating the transporting of the luggage; and a pair of feet extending downwardly from front portions of said lower cast skeletal frame member and cast integral therewith and providing front support for the luggage when in an upright position, the lower ends of said feet being in a common plane with the lower portions of said wheels so that the luggage may be positioned in an upright position.

* * * * *

UNITED STATES PATENT AND TRADEMARK OFFICE

CERTIFICATE OF CORRECTION

PATENT NO. : 5,295,565

DATED : March 22, 1994

INVENTOR(S) : Ricky Latshaw

It is certified that error appears in the above-identified patent and that said Letters Patent is hereby corrected as shown below:

Column 1, line 36, "PullHandle" should be -- Pull Handle --.

Column 3, line 6, "15 15" should be -- 15-15 --.

Column 5, line 55, "cross. sectional" should be -- cross-sectional --.

Column 7, line 12, "case" should be -- cast --.

Column 7, line 36, after "handle" delete the -- , --.

Column 7, line 38, after "members" delete the -- , --.

Column 7, line 41, "case" should be -- cast --.

Signed and Sealed this

Fifth Day of July, 1994

Bruce Lehman

*Attest:*

BRUCE LEHMAN

*Attesting Officer*

*Commissioner of Patents and Trademarks*